US006434452B1

(12) United States Patent
Gray

(10) Patent No.: US 6,434,452 B1
(45) Date of Patent: Aug. 13, 2002

(54) TRACK DATABASE INTEGRITY MONITOR FOR ENHANCED RAILROAD SAFETY DISTRIBUTED POWER

(75) Inventor: Robert Gray, Erie, PA (US)

(73) Assignee: General Electric Company, Erie, PA (US)

( * ) Notice: Subject to any disclaimer, the term of this patent is extended or adjusted under 35 U.S.C. 154(b) by 0 days.

(21) Appl. No.: 09/999,461

(22) Filed: Oct. 31, 2001

Related U.S. Application Data

(60) Provisional application No. 60/244,731, filed on Oct. 31, 2000.

(51) Int. Cl.[7] ..... B61C 17/00
(52) U.S. Cl. ..... 701/19; 246/182 R
(58) Field of Search ..... 701/19, 117; 246/182 R, 246/122 R, 182 B, 182 C

(56) References Cited

U.S. PATENT DOCUMENTS 5,738,311 A 4/1998 Fernandez ..... 246/168
5,950,967 A 9/1999 Montgomery ..... 246/182 R
5,956,664 A 9/1999 Bryan ..... 702/184
5,978,717 A 11/1999 Ebersöhn et al. ..... 701/19
6,218,961 B1 * 4/2001 Gross et al. ..... 340/903
6,332,107 B1 * 12/2001 Gordon et al. ..... 701/20

OTHER PUBLICATIONS

Hinrichs, Paul R., Advanced Terrain Correlation Techniques, IEEE Plans 76, pp. 89–96, E–Systems, Inc., Garland Division, Dallas, Texas.

* cited by examiner

*Primary Examiner*—William A. Cuchlinski, Jr.
*Assistant Examiner*—Marthe Y. Marc-Coleman
(74) *Attorney, Agent, or Firm*—Terry M. Sanks, Esq.; Beusse Brownlee Brownlee & Wolter, PA; Carl A. Rowold, Esq.

(57) ABSTRACT

A distributed power system for remotely controlling a locomotive, the system comprising a position-determining device for determining a position of the locomotive, a pre-stored track database comprising terrain and contour data about a railroad track, a track database integrity monitor for detecting errors with the pre-stored track database, a processor comprising an algorithm to determine a distributed power for the locomotive and to use the track database integrity monitor to determine if errors exist in the pre-stored track database, and a memory device connected to the processor.

39 Claims, 4 Drawing Sheets

TRACK DATABASE INTEGRITY MONITOR FOR ENHANCED RAILROAD SAFETY DISTRIBUTED POWER

This application takes benefit of provisional application serial No. 60/244,731 filed Oct. 31, 2000.

BACKGROUND OF THE INVENTION

The present invention relates to a train's distributed power control operations, and more specifically to a track database integrity monitor and method applied to a distributed power control system to enhance railroad safety during all-weather, day and night railroad operations when the train is in a distributed power mode of operation.

Trains, especially freight trains, often include so many cars that multiple locomotives are utilized to move and operate the train. These multiple locomotives as generally dispersed throughout the line of cars. In these situations, even though a train's engineer cannot have complete visual contact with the total length of the train, the engineer is relied upon to have intimate knowledge and remember past, current, and upcoming train track path conditions such as grades, turns, and inclines along the route at all times, in total darkness as well as in all weather conditions in order to make optimal decisions regarding slowing or braking, and increasing throttle power for upcoming hills and valleys.

Train control and safety concerns are further added to an engineer's tasks while in a distributed power mode condition. Typically, when a group of locomotives are used in a train, one acts as a master locomotive and the others act as slave locomotives. Under this concept, the throttle and brake controls of the slave locomotives are performed as a result of commands received from the master locomotive, where the engineer is usually located. Distributed power control systems generally utilize radio frequency communication modules mounted in each respective locomotive of a train to send and receive throttle and brake setting commands.

Occurrences sometime arise where not enough time is available for the engineer to communicate to each locomotive. For example, suppose a train includes three locomotives, one each at the beginning, middle, and end of a train, and the lead locomotive has begun descending down a steep hill while the second locomotive is at the crest of the hill and the third locomotive is just beginning to climb the hill. The momentum of the first locomotive is attempting to increase due to the force of gravity and attempts to speed-up which can cause its wheels to slip and exerts greater force on the couplings. The train engineer begins to decrease the throttle and applies dynamic braking to the first locomotive. The engineer does not have enough time to separately control the third locomotive, thus the third locomotive may be throttled-back and have brakes applied as it is attempting to climb the hill.

Damage may occur to the train couplings, the third locomotive, or the locomotive may separate, due to the vector force component of gravity pulling the third locomotive in the opposite direction of the first locomotive.

Similarly, with the continued development of locomotives, future locomotives may be developed that can handle the load of several current locomotives. Thus instead of using several locomotives for one train, the number of locomotives may reduce to as few as one. As locomotives are further developed, the responsibilities of the engineer may increase or the engineer's job emphasis may change. For example, many tasks currently performed by the engineer, such as distributing power based on a location of a train or locomotive may become automated. With this in mind, a disputed power system, in a general sense can be viewed as a system to remotely operate and apply power disputation to a locomotive.

With the development of computers and computer software, systems and methods are being currently developed which use sensors or simulation software to assist in independently controlling all slave locomotives in a train, by using a position-determining device, and a database containing track topography. However, it is believed that such systems simply use a position of a train compared to pre-stored track database to provide distributed power for the train. Such an approach however, does not appear to consider weather conditions and other environmental conditions that are constantly changing. Furthermore, such a system does not have a mechanism to determine whether the pre-stored track database is error-free or whether the position-determining device, such as a Global Positioning System, is providing correct location data to the system.

One example of the type of errors which may be realized with respect to a pre-stored track database are blunder errors. Blunder errors could result because of the inherent nature of human error in piecing together sections of digitized track data. In another scenario, equipment malfunctions may cause bad data points to be recorded during the digitization of the track database. Some errors may also occur due to a high likelihood of more than one absolute single manufactured source of a track database.

Other errors may occur because of physical track changes which may unknowingly have occurred over time due to natural causes, disasters, or scheduled maintenance. Yet other errors may occur as a result of reference frame errors. In this situation, the reference data may be based on a precise track data referenced to a specific datum, such as World Geodetic Survey (WGS)84. However, a certain locomotive may be using precise track data referenced to a different datum, such as WGS 72. Another possible error can occur if the position information, provided by the position-determining device, is in error because of space or control segment anomalies.

SUMMARY OF THE INVENTION

Towards this end, it would be beneficial if an enhanced locomotive distributed power system existed that integrated a track database integrity monitor to monitor and anticipate errors when a train is operating in a distributed power mode. Thus, a distributed power system for remotely controlling a locomotive is presented. The system comprises a position-determining device for determining a position of the locomotive. A pre track database comprising terrain and contour data about a railroad track is also included. A track database integrity monitor for detecting errors with the pre-stored track database, and a processor comprising an algorithm to determine a distributed power for the locomotive and to use the track database integrity monitor to determine if errors exist in the pre-stored track database are also provided. The system also comprises a memory device connected to the processor.

The present invention also discloses a method for remotely controlling a locomotive. The method comprises determining a position of the locomotive with a position-determining device. The method also provides for a pre-stored track database comprising track terrain and contour information, coupler sensor data. Processing the position of the train, the coupler sensor data and comparing the position with the pre-stored track database to determine a distributed power to apply to the master locomotive and the slave locomotive also occurs in the method. A track database integrity monitor to determine whether the pre-stored track database and the position correlate is applied. If the track database integrity monitor corresponds with the pre-stored track database, a distributed power is calculated and applied to the master locomotive and the slave locomotive. A second track database based on applying the track database integrity monitor is created. A second track database is saved in a memory device.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 6:
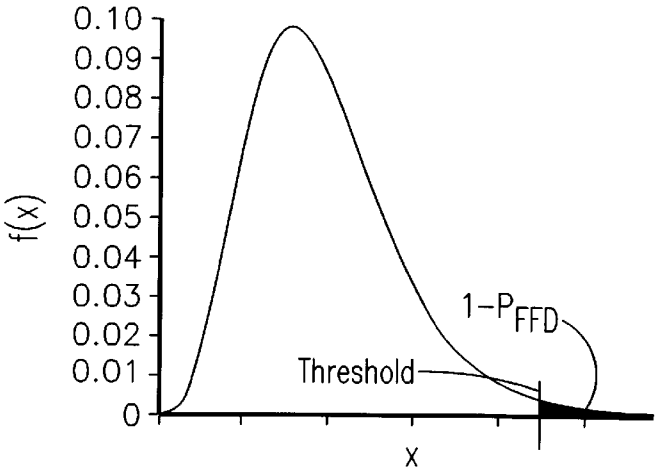
FIG. 6 is a Chi-Square Distribution with 10 Degrees of Freedom.

Before describing in detail various aspects of the present invention, it should be observed that the present invention broadly comprises a novel combination components and/or processes configured to quickly and reliably meet the need for a track database integrity monitor as part of an enhanced railroad safety distributed power system. Accordingly, these components/processes have been represented by generic elements in the drawings, showing only those specific details that are pertinent to the present invention, so as not to obscure the disclosure with structural details or operational interrelationships that will be readily apparent to those skilled in the art having the benefit of the description herein.

Figure 1:
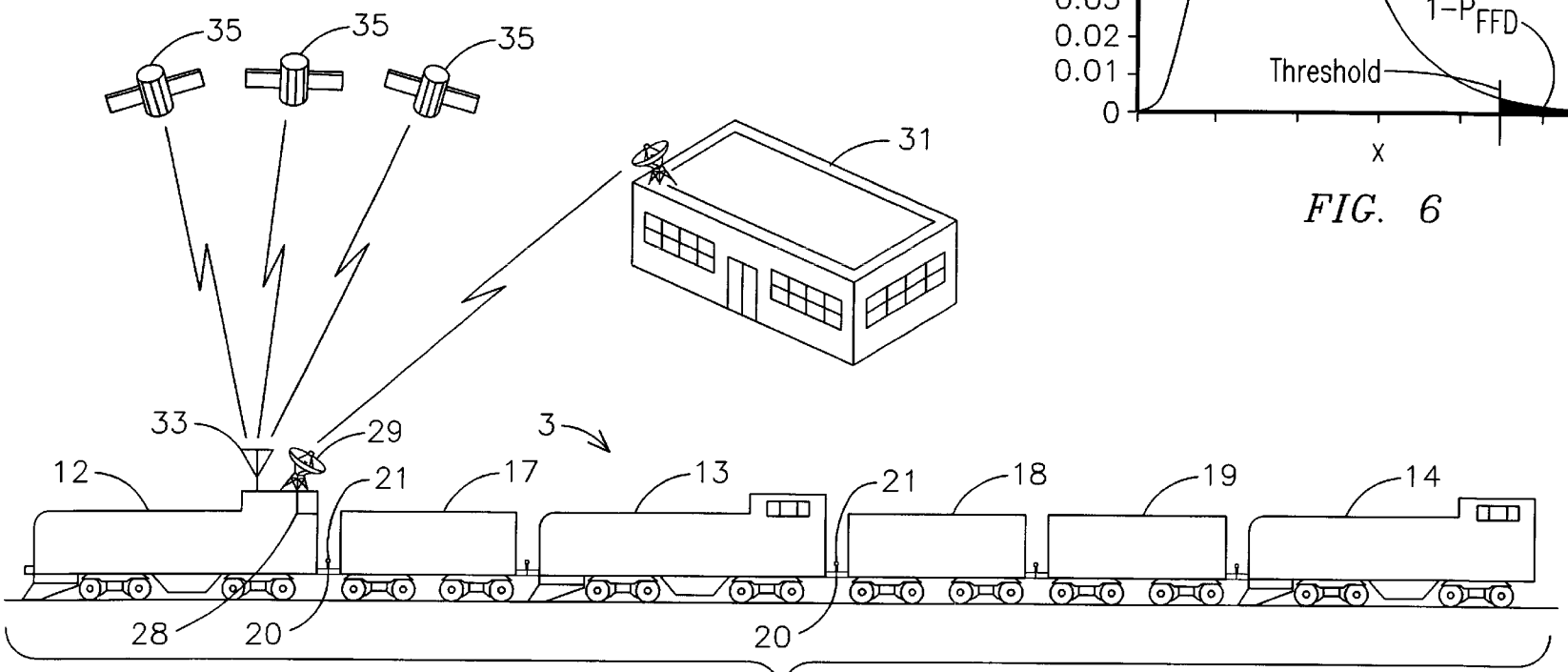
FIG. 1 is an illustration of a train with several locomotives with a position-determining device.

FIG. 1 is an exemplary illustration of a train with several locomotives where the train has a position-determining device. The train 3 includes several locomotives 12, 13, 14 and non-power cars 17, 18, 19 where all locomotives 12, 13, 14 and cars 17, 18, 19 are connected together by couplers 20. In another embodiment, not shown, the train 3 only includes one locomotive and non-powered cars. As illustrated, the first locomotive 12 is a master locomotive and the other locomotives 13, 14 are slave locomotives. The master locomotive 12 includes a transceiver 29 to send and receive data between the train 3 and a remote monitoring facility 31, and a receiver 33 that collects position-determining data from a Global Positioning System (GPS) 35. This collected data is fed into a position-determining device or sensor 28. In one embodiment, the transceiver and receiver are an integrated unit representing a single communication device. In one embodiment, position-determining data is provided by the remote monitoring facility 31 and is sent to the position-determining device 28.

Figure 2:
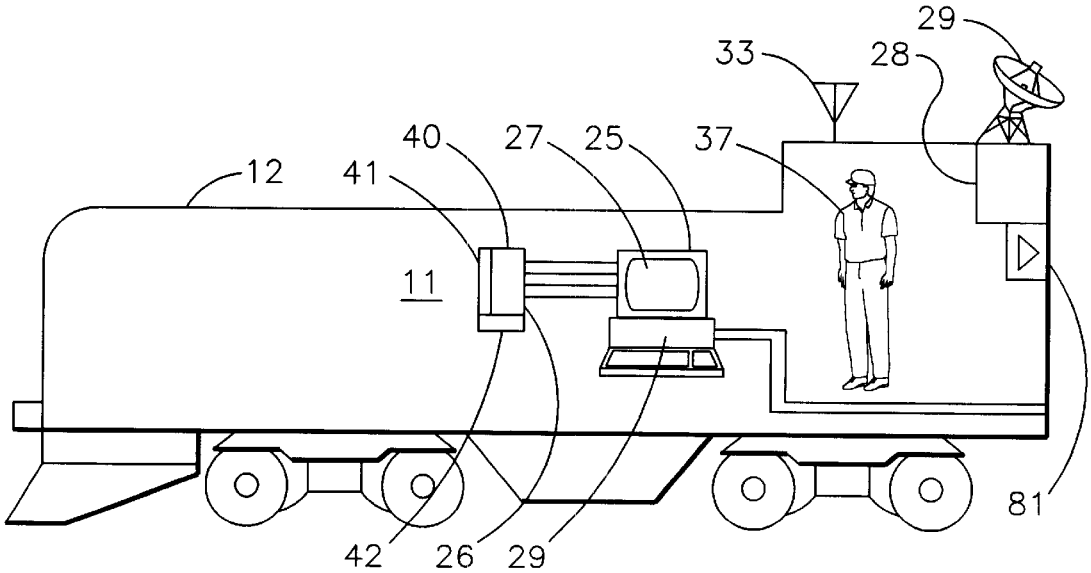
FIG. 2 is an illustration of several components that comprise the system.

FIG. 2 is an illustration of key components that comprise the system. The system 11 has a data processing device or processor 25, such as a computer, which receives all external information and position-determining data and calculates current and anticipated distributed power for each locomotive 12, 13, 14. The computer includes a monitor 27 or some other message or warning delivery device, such as audible tones, text message center, moving map video or other visual cues, which presents the data to an engineer 37 to verify and override if the engineer 37 decides a need arises. The processor 25 can also function as a controller to implement distributed power or a separate controller can be used. A memory device 40 is also connected to the processor 25 which contains a pre-stored digitized track database 26. The track database 26 contains terrain and contour data about a railroad track. In one embodiment, the pre-stored digitized track database 26 can also comprise train characteristics, such as the number of cars and locomotives, and digital terrain track elevation and contour data is stored in a data storage device 40. The pre-stored digitized track database 26 can be expanded to include weight of the cars 17, 18, 19 and locomotives 12, 13, 14, as well as maintenance records of the locomotives 12, 13, 14, and other relevant information, for use in calculating optimum distributed power settings for each locomotive 12, 13, 14. The pre-stored digitized track database 26 can also contain Gazetteer information, such as railroad speed limits, town names, mile-makers or other useful safety information. In another embodiment, the pre-stored track database does not contain this additional data. This additional data resides in an independent database 41 or a plurality of databases. This data may reside in the memory device 40 or may reside at the remote monitoring facility 31 and is then transmitted to the train 3 periodically. Collectively and individually, this additional data can be referred to as situational data. The processor 25 is also connected to a railroad track profile database integrity monitor 42. Also illustrated is the position-determining device 28 and the warning device 81.

As further illustrated in FIG. 1, sensors 21 are integrated with the couplers 20 to determine coupler forces transmitted through the corresponding couplers. This data is relayed to the system 11 to assist in determining a proper distributed power for each locomotive 12, 13, 14. This data is relayed either through a hard connection, such as wires, or through a wireless system, such as radio signals.

Other data transmitted from the remote monitoring facility 31 to the system 11 via the transceiver 29 may include weather conditions, real-time track conditions, night-time parameter limitation factors, railroad crossing traffic information, and other environmental information that is constantly changing, including other sensor data about the locomotives. In one embodiment, based on the engineer's observations, the engineer 37 also has the option of entering real-time track conditions into the system by way of a data entry device 39 such as a computer keyboard. The computer 25, via the transceiver 29, can send distributed power mode settings, manual data entered by the engineer, or other data collected to the remote monitoring facility 31. The collected GPS data that is utilized in calculating a distributed power include, but is not limited to, date and time information, latitude and longitude locations, velocity of the locomotive, heading, altitude, and possibly other data that is available from the GPS 35 via the receiver 35.

Figure 3:
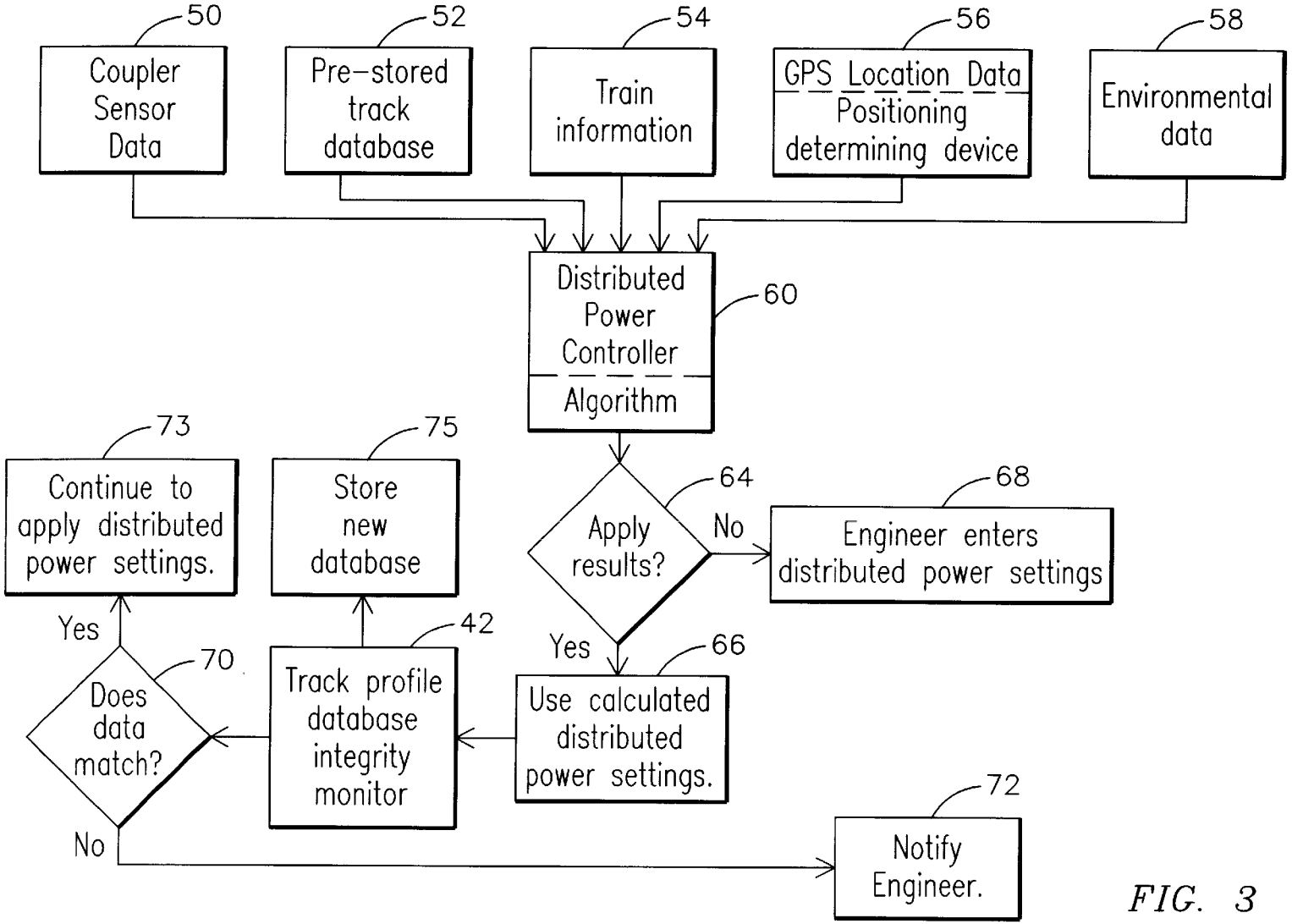
FIG. 3 is an exemplary block diagram of a distributed power system of the present invention.

FIG. 3 is an exemplary block diagram of a distributed power control system of the present invention. In this embodiment, coupler sensor data 50, digital terrain track elevation and contour data, or pre-stored digitized track database 52, train information 54, GPS location data 56, and environmental conditions 58 are fed into a controller, such as a control algorithm 60. In another embodiment, the controller can be a mechanical or electrical controller. In one embodiment, the GPS location data is supplied to a position-determining device before being fed into the control algorithm 60. In another embodiment, not shown, the position-determining device is part of the control algorithm 60. Any of the data discussed above can be either entered remotely from the remote facility to the train, entered manually by engineer, or provided in a database.

Figure 4:
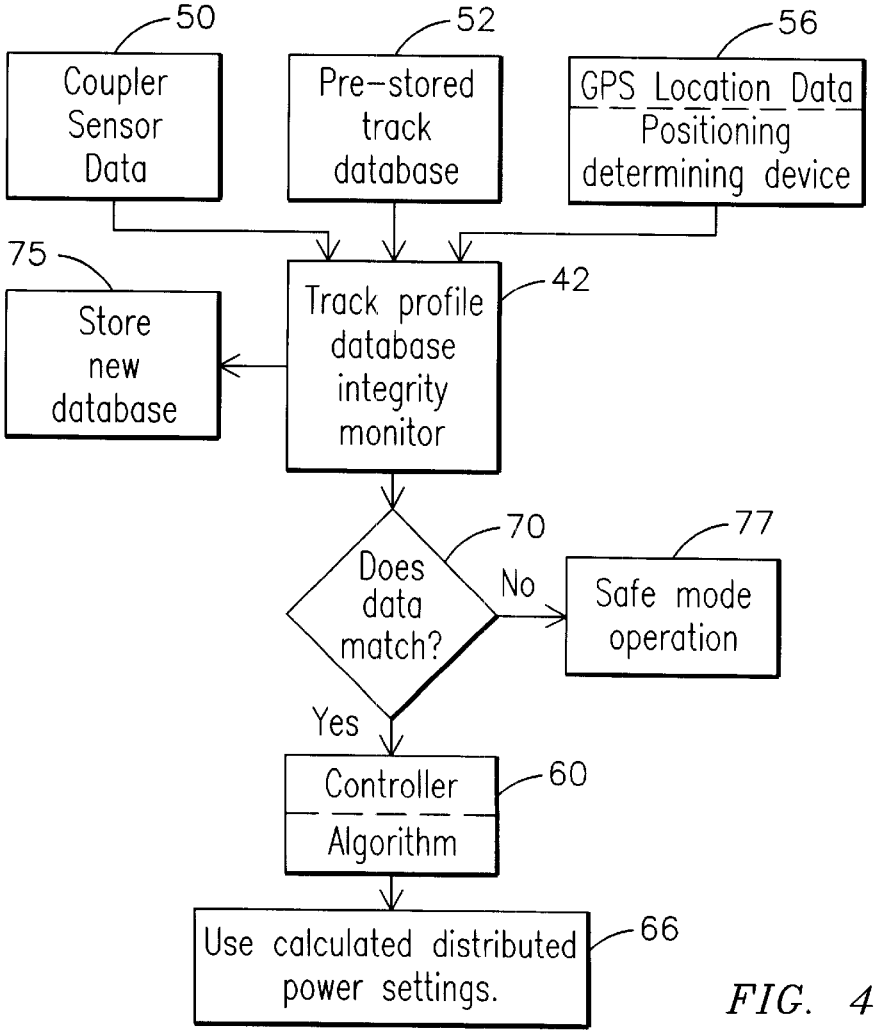
FIG. 4 is an exemplary block diagram of a distributed power system of the present invention.

In one embodiment as illustrated in FIG. 4, only the coupler sensor data 50, pre-stored digitized track database 52, and GPS data 56 are all that is needed to be fed into a control algorithm 60. The algorithm 60 will calculate the throttle and brake settings for current and pending track changes, such as inclines, declines, or contour changes, for all locomotives and display this information to, or notify the engineer. The system then includes a decision gate, step 64. The engineer 37 can either allow the system to make these changes autonomously, step 66 or the engineer may enter modified settings, step 68. In one embodiment, as further illustrated in FIG. 4, the decision gate, step 64 does not exist and the system automatically applies the determined distributed power, step 66.

Any of this data 50, 52, 54, 56, 58, 60 can be stored in the storage, or memory device 40 for delivery to the remote monitoring facility 31 either real-time or at a predetermined time via the transceiver 29. As the train calculates and implements the distributed power, in one embodiment, a railroad track profile database integrity monitor 42 is used wherein the data collected and processed is compared to the pre-stored digitized track database 52 and a new database is established. In another embodiment, instead of using data about railroad track recently covered by the train, the railroad track profile database integrity monitor 42 uses a forward looking device, such as a laser ranging device to determine the terrain the train is about to cover and this information is compared to the pre-stored digitized track database. As in the other embodiment, the resulting data is saved as a new database.

In another embodiment, illustrated in FIG. 4, the track profile database integrity monitor is applied before distributed power is calculated and the complete system is automated, specifically an engineer's role is minimum. One skilled in the art will recognize that the invention disclosed can be performed in a number of varying steps or processes and that FIGS. 3–4 are exemplary embodiments of two such processes.

As further illustrated in FIG. 3, if the comparison of data does not equate, step 70, the engineer is notified by the warning device 81 and the engineer 37 is responsible for determining a proper distributed power setting. In another embodiment, further illustrated in FIG. 4, the system automatically operates the train in a safe mode, step 77. The safe mode may bring the train to a stop, or operate the train at a speed less than it is usually operated. In other words, in this embodiment, the engineer does not make a decision based on the comparison of data. Instead, the system makes the decision. If the comparison of data does equate, the system will continue to apply a calculated distributed power setting, step 73. Under either situation, the resulting database built based on the comparison is stored, step 75 in the memory device 40 and can be transmitted back to the remote monitoring facility 31.

Figure 5:
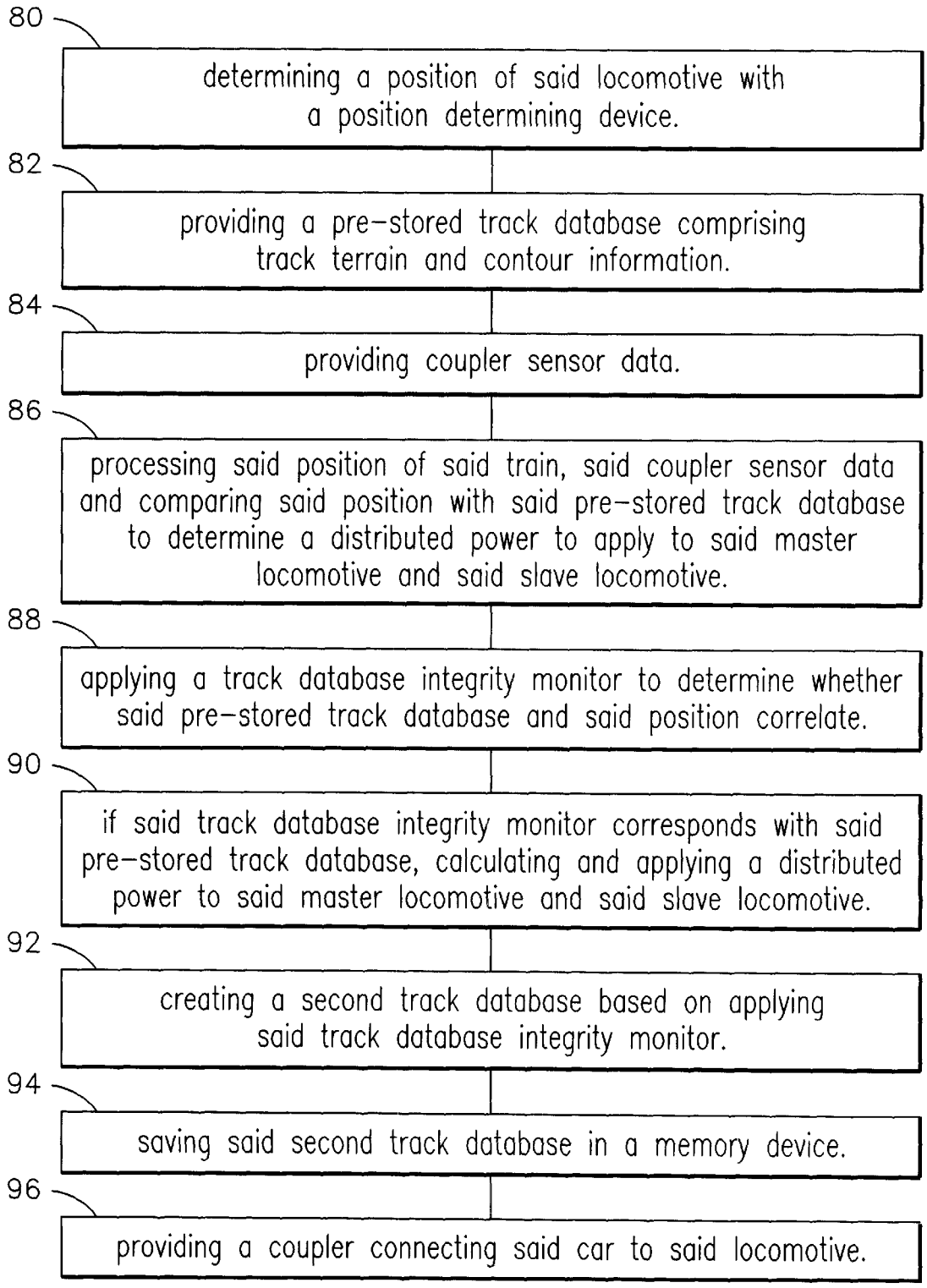
FIG. 5 is an exemplary embodiment of a flow chart illustrating the steps the distributed system may use.

FIG. 5 is an exemplary embodiment of a flow chart illustrating the steps the distributed system may use. As one skilled in the art will recognize, these steps can be arranged in various orders. This method is functional for a train with a single locomotive and with a train having a master locomotive and a slave locomotive.

In operation, a determination must be made where a locomotive, or train is located, step 80. The location can be found using a position-determining device 28. A pre-stored track database is provided, step coupler is provided, step 96 as well as coupler sensor data, step 84. The position of the train, coupler sensor data and comparing the position with the pre-stored track database is all processed to determine a distributed power, step 86. A track database integrity monitor is applied to determine whether the pre-stored track database and the position correlate, step 88. If the track database integrity monitor corresponds with the pre-stored track database, a distributed power is calculated and applied, step 90. A second track database is created based on applying the track database integrity monitor, step 92. The second track database is saved in a memory device, step 93. In other embodiments, a new force to be applied to a coupler can be determined using the processor and the force can be optimized based on a calculated distributed power, not shown.

The railroad track profile database integrity monitor 42 is an algorithm that can detect errors by synthesizing estimated track terrain contours integrated with a position device, such as GPS or an equivalent position device, where the synthesized output is compared with the pre-stored digitized track database.

In a preferred embodiment, a three-dimensional locomotive profile is compared with the pre-stored digitized track database. In other preferred embodiments, a one-dimensional or two-dimensional locomotive profile can also be used. The dimensions that could be included are an elevation channel, a horizontal channel, and/or a time channel. One skilled in the art will realize the benefits of using more dimensions, but for simplicity, only a one-dimensional profile will be discussed in further detail. The following example utilizes a one-dimensional vertical (elevation) channel for a locomotive.

For the vertical channel, two basic metrics used to express a degree of agreement between elevation of a synthesized and a pre-stored track database are absolute and successive disparities. The absolute disparity is calculated by:

$$p(t_i)=h_{SYNT}(t_i)-h_{TRACK}(t_i),$$

where $h_{SYNT}$ is the synthesized height and $h_{TRACK}$, is the height as derived from the track elevation database. Both elevations are defined at time t. The synthesized height is given by a height above Mean Sea Level (MSL), referenced by an appropriate geographical identification marker, as derived from a positioning system, such as GPS measurements, $h_{GPS}$. Accordingly, $$h_{SYNT}(t_i)=h_{GPS}(t_i)$$

The successive disparity is calculated by:

$$s(t_i)=p(t_i)-p(t_{i-1})$$

A main advantage of subtracting the previous absolute disparity from the current absolute disparity is the ability to remove bias errors.

Under error-free conditions the synthesized height, $h_{SYNT}$, and the height derived from the track database, $h_{TRACK}$, should be equal, resulting in an ideal absolute disparity equal to zero. However, the positioning sensors and/or the track profile database may contain errors as previously discussed. To implement the integrity monitor 42, test statistics are then derived based on functions such as the absolute and successive disparity algorithms, as provided above. Test statistics are indicators or measure of agreement based on the system's nominal or fault free performance. If the test statistics exceed a pre-defined detection threshold, an integrity alarm, or another notice to an engineer results.

Computation of the detection thresholds requires predefined false alarm and missed detection rates. Computation of the detection thresholds will also require an understanding of the underlying system fault mechanisms and characterization of the nominal system error performance described by the probability density functions ("PDFs") of both the track profile database errors and errors in the sensors used to derive the synthesized elevations.

Possible disparity functions that may be used for locomotive track integrity monitoring are the Mean Absolute Difference, Mean-Square ("MSD") difference, and the Cross-Correlation-type functions. One skilled in the art will recognize the benefits of using any of these algorithms. Additionally, one skilled in the art will realize that two or more types of disparity algorithms could be used wherein neural networks can also be used for track profile integrity monitoring. The above are just a few examples and one skilled in the art will recognize that many different types of disparity functions exist or could be derived. As an illustration, only the MSD absolute and successive disparity equation algorithms are discussed in detail in the present invention.

For the MSD function, the derived test statistics from the absolute and successive disparities are stated with N being interpreted as an integration time:

$$T=\frac{1}{\sigma^2}\sum_{i=1}^{N} p^2(t_i)$$

$$Z=\frac{1}{2\sigma^2(N-1)}\sum_{i=2}^{N} s^2(t_i)$$

Based on a given underlying normal distributions of the absolute and successive disparities, T is found to be a chi-square distribution with N degrees of freedom and Z is found to be a nominal distribution for N>20. FIG. 4 illustrates a chi-square distribution, and the graphical derivation of the concept for threshold calculations for the probability of fault-free detection, $P_{FFD}$. Specific rules, which may include speed limitations, track conditions, velocity of the locomotive, known elevation grades, location of actual track profiles, "roughness of track terrain," etc., could be used in determining a priori fault free detection probability value and in dynamically determining the integrity monitor integration time. For example, it may be possible to declare the locomotive probability of fault free detection at $P_{FFD}$= 0.9999, and an integration time of 60 seconds wherein the time is based on current and predicted locomotive velocities. This information would then be used in determining a safe locomotive distributed power operational required threshold, $T_D$. Thresholds can be calculated a priori or on the fly based on prior track profile analysis. Prior track analysis provides insight of the underlying error PDFs and their respective mean and variance.

The present invention can be embodied in the form of computer-implemented processes and apparatus for practicing those processes. The present invention can also be embodied in the form of computer program code including computer-readable instructions embodied in tangible media, such as floppy disks, CD-ROMS, DVDs, hard drives, or any other computer-readable storage medium, wherein when the computer program code is loaded into and executed by a computer(s), the computer(s) becomes an apparatus for practicing the invention. When implemented on a computer (s), the computer program code segments configure the computer(s) to create specific logic circuits or processing modules.

While the invention has been described in what is presently considered to be the preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. A distributed power system for remotely controlling a locomotive, said system comprising:

a position-determining device for determining a position of said locomotive;

a pre-stored track database comprising terrain and contour data about a railroad track;

a track database integrity monitor for detecting errors with said pre-stored track database;

a processor comprising an algorithm to determine a distributed power for said locomotive and to use said track database integrity monitor to determine if errors exist in said pre-stored track database; and a memory device connected to said processor.

2. The system of claim 1 further comprising a remote monitoring facility and a communication device to communicate between said locomotive and said monitoring facility.

3. The system of claim 1 further comprising a second database comprising situational data.

4. The system of claim 1 wherein said track database integrity monitor detects an error in said pre-stored track database by synthesizing estimated track terrain contours.

5. The system of claim 4 wherein said position-determining device is used to compare said synthesized terrain contours with said pre-stored track database.

6. The system of claim 1 wherein said track database integrity monitor uses a three-dimensional train profile for comparison with said pre-stored track database.

7. The system of claim 1 wherein said track database integrity monitor uses a two-dimensional train profile for comparison with said pre-stored track database.

8. The system of claim 1 wherein said track database integrity monitor uses a one-dimensional train profile for comparison with said pre-stored track database.

9. The system of claim 8 wherein said one-dimensional train profile is a horizontal channel.

10. The system of claim 8 wherein said one-dimensional train profile is a vertical channel.

11. The system of claim 8 wherein said one-dimensional train profile is a time channel.

12. The system of claim 1 wherein said track database integrity monitor uses a disparity algorithm for integrity monitoring.

13. The system of claim 12 wherein said disparity algorithm is a Mean Absolute Difference algorithm.

14. The system of claim 12 wherein said disparity algorithm is a Mean-Square Difference algorithm.

15. The system of claim 1 wherein said memory device stores said pre-stored track database.

16. The system of claim 1 further comprising a second track database created by using said track database integrity monitor.

17. The system of claim 16 wherein said second track database is stored in said memory device.

18. The system of claim 1 further comprising a controller connected to said processor for controlling said locomotive.

19. A method for remotely controlling a locomotive, said method comprising:

determining a position of said locomotive with a position-determining device;

providing a pre-stored track database comprising track terrain and contour information;

providing coupler sensor data;

processing said position of said train, said coupler sensor data and comparing said position with said pre-stored track database to determine a distributed power to apply to said locomotive;

applying a track database integrity monitor to determine whether said pre-stored track database and said position correlate;

if said track database integrity monitor corresponds with said pre-stored track database, calculating and applying a distributed power to said locomotive; and creating a second track database based on applying said track database integrity monitor.

20. The method of claim 19 further comprising if said track database integrity monitor does not correspond with said pre-stored track database and said position, (warming a) warning locomotive personnel.

21. The method of claim 19 further comprising if said track database integrity monitor does not correspond with said pre-stored track database and said position, operating said locomotive in a safe mode.

22. The method of claim 19 further comprising:

providing a car connected to said locomotive;

providing a coupler connecting said car to said locomotive;

determining a force at said coupler using said processor; and optimizing said force based on a calculated distributed power.

23. The method of claim 19 wherein said processing step further comprises providing environmental data and factoring in said environmental data when determining said distributed power.

24. The method of claim 19 wherein said processing step further comprises providing situational data and factoring in said situational data when determining said distributed power.

25. The method of claim 19 wherein said track database integrity monitor comprises applying a disparity algorithm for integrity monitoring.

26. The method of claim 19 wherein said track database integrity monitor comprises a dimensional locomotive profile.

27. The method of claim 19 wherein said track database integrity monitor comprises a plurality of dimensional train profiles.

28. The method of claim 19 further comprising saving said second track database in a memory device.

29. A distributed power control system for controlling a train having a master locomotive and a slave locomotive where a car separates said master locomotive and said slave locomotive, said system comprising:

a position-determining device for determining a position of said train;

a pre-stored track database comprising terrain and contour data about a railroad track;

a track database integrity monitor for detecting errors with said pre-stored track database based on a position of said train;

a coupler separating each said locomotive from said car;

a coupler sensor to determine force applied to each said coupler;

a processor comprising an algorithm to determine a distributed power for said locomotive based on data received from said coupler sensor and to use said track database integrity monitor to determine if errors exist in said pre-stored track database;

a memory device connected to said processor; and wherein said processor controls said train based on a calculated distributed power.

30. The system of claim 29 wherein said track database integrity monitor compares positioning data based on railroad track recently covered by with said pre-stored digitized track database to determine whether an error exists in a position of said train.

31. The system of claim 29 wherein said track database integrity monitor compares positioning data based on railroad track said train is about to cover with said pre-stored digitized track database to determine whether an error exists in a position of said train.

32. The system of claim 31 wherein a forward-looking device is used to identify said railroad track said train is about to cover.

33. The system of claim 29 wherein said track database integrity monitor uses a disparity algorithm.

34. The system of claim 29 wherein said track database integrity monitor detects an error in said pre-stored track database by synthesizing estimated track terrain contours.

35. The system of claim 29 wherein said track database integrity monitor uses a dimensional train profile for comparison with said pre-stored track database.

36. The system of claim 29 further comprising a warning device to notify train personnel that said track database integrity monitor found an error.

37. A method for distributing power in a (training) train with a master locomotive and a slave locomotive, said method comprising:

providing a position-determining device;

determining a position of said locomotive with a position-determining device;

providing a pre-stored track database comprising track terrain and contour information;

providing coupler sensor data;

processing said position of said train, said coupler sensor data and comparing said position with said pre-stored track database to determine a distributed power to apply to said master locomotive and said slave locomotive;

applying a track database integrity monitor to determine whether said pre-stored track database and said position correlate;

if said track database integrity monitor corresponds with said pre-stored track database, calculating and applying a distributed power to said master locomotive and said slave locomotive;

creating a second track database based on applying said track database integrity monitor;

providing couplers in said train;

determining a force at each said couplers using said processor;

optimizing said force based on a calculated distributed power; and saving said second track database in a memory device.

38. The method of claim 37 further comprising if said track database integrity monitor does not correspond with said pre-stored track database and said position, warming a train personnel.

39. The method of claim 37 further comprising if said track database integrity monitor does not correspond with said pre-stored track database and said position, operating said train in a safe mode.

* * * * *